United States Patent [19]

Karr

[11] Patent Number: 4,465,244

[45] Date of Patent: Aug. 14, 1984

[54] EXPANDING CORE CHUCK

[75] Inventor: Gerald W. Karr, South Beloit, Ill.

[73] Assignee: Beloit Corporation, Beloit, Wis.

[21] Appl. No.: 334,822

[22] Filed: Dec. 28, 1981

[51] Int. Cl.[3] ..... B65H 75/24; B23B 31/40

[52] U.S. Cl. ..... 242/72.1; 279/2 R

[58] Field of Search ..... 242/72 R, 72 B, 72.1, 242/73, 68.2; 279/2 R, 2 A; 269/48.1, 48.2, 48.3, 48.4

[56] References Cited

U.S. PATENT DOCUMENTS

| | | | |
|---|---|---|---|
| 1,750,433 | 3/1930 | Rosche | 279/2 A |
| 1,928,979 | 10/1933 | Levison | 242/72.1 X |
| 2,299,101 | 10/1942 | MacChesney | 242/72.1 |
| 2,352,580 | 6/1944 | Wettengel | 242/72.1 X |
| 2,413,103 | 12/1946 | Forbes, Jr. | 269/48.1 X |
| 2,615,644 | 10/1952 | Enz | 242/72.1 |
| 3,542,383 | 11/1970 | Farley et al. | 279/2 R |
| 3,623,741 | 11/1971 | Reeder, Jr. et al. | 279/1 DA |
| 3,797,772 | 3/1974 | Lucas | 242/72.1 |
| 4,067,511 | 1/1978 | Hermanns | 242/72.1 |

*Primary Examiner*—Stuart S. Levy
*Assistant Examiner*—Scott J. Haugland
*Attorney, Agent, or Firm*—Hill, Van Santen, Steadman & Simpson

[57] ABSTRACT

For use in a papermaking machine or paper converting mechanism having an arrangement for winding a roll of paper onto a core at high speed, an expanding core chuck for insertion into a roll core which includes a spindle mounted for rotation within a housing, a cone mounted on the spindle and having camming surfaces thereon, a piston reciprocable axially of the spindle, means for introducing hydrostatic pressure to one end of the piston, a cup secured to the opposite end of the piston and having a plurality of radially deflectable leaves in spaced relation therearound. The leaves have angular surfaces thereon engageable by the camming surfaces on the core. When the angular surfaces are contacted by the camming surfaces of the core due to movement of the piston, the leaves are deflected outwardly into tight fitting relationship within the interior of the roll core.

10 Claims, 5 Drawing Figures

EXPANDING CORE CHUCK

BACKGROUND OF THE INVENTION

1. Field of the Invention

This invention is in the field of expandable chucks for supporting a roll of web material such as paper for winding or unwinding. The chuck of the present invention uses a one-piece expanding member which provides its own retaining action and has a plurality of expanding elements which engage the inner diameter of the roll core. The expanding elements are actuated by hydraulic pressure operating through a spindle and against a piston to provide tight engagement between the expanding elements and the inner diameter of the roll core.

2. Description of the Prior Art

When paper is wound on cores such that the weight of the roll must be supported by the cores rather than by winder drums, the supporting members in the form of chucks must fit tightly in the core so that an internal gearing effect does not take place.

Previously proposed designs of expanding chucks provided for expansion by means of a manually rotated screw thread which had to be carried out before winding took place. Other forms of core chucks used a wedging action of tapered pieces which slid up inclines by means of axial thrust exerted on the cores. In such devices, friction became a factor which prevented them from functioning as required.

Most expanding core chucks of the prior art used segmented pieces on the order of 3 or 4 which expanded radially away from each other. These pieces had to be retracted or held in place by means of a garter spring, a circular coil spring, or a rubber retainer. The relatively small number of outwardly expanding elements tended to make the cores go out-of-round in quadrants of the core, necessitating a reworking of the cores to make them round before they could be used again.

An improved form of expansible chuck is shown in U.S. Pat. No. 3,623,741 to Reeder et al, and assigned to the assignee of the present application. This chuck had a plurality of elongated chucking members disposed about a rotatable central camshaft. Radial expansion was achieved by simultaneous outward movement of the members relative to the rotational axis of the camshaft. Each of the chucking members had two spaced coaxially mounted yokes supported by corresponding circular cams located along the camshaft and offset from its rotational axis. A positioning ring concentric with the chuck axis was provided with radial guide pins to maintain the chucking members in equally spaced angular relation to each other as they moved outwardly in unison as a result of torque developed between the camshaft and any of the chucking members.

Another improved chucking device was described in Lucas U.S. Pat. No. 3,797,772 also owned by the assignee of the present invention. This patent described an expansible chuck having a spindle and a chuck bearing housing freely rotatable on the spindle. The bearing housing had external frusto-conical surfaces engaged by spaced internal frusto-conical segments on the insides of chuck leaves, and being guided in the chuck bearing housing for movement therein. An externally threaded member was provided which was connected with the chuck leaves to cause translational movement of the chuck leaves upon turning of the threaded member. Locking means were provided to engage the threaded member and hold it from rotation relative to the chuck bearing housing, to hold the chuck leaves in position.

SUMMARY OF THE INVENTION

The present invention provides an expanding core chuck for insertion into a roll core which makes use of a one-piece expanding member which provides its own retaining spring and has a large number of expanding elements. The expansion takes place by means of hydraulic pressure which is supplied through a rotary joint on one end of the spindle. Specifically, the improved expanding core chuck of the present invention includes a housing, a spindle mounted for rotation within the housing, and a cone mounted on the spindle and having camming surfaces thereon. A piston is reciprocably mounted axially of the spindle. Hydrostatic pressure is applied to one end of the piston from a rotary joint at one end of the housing. A cup is secured to the spindle, the cup having a plurality of radially deflectable leaves in spaced relation therearound, the leaves having angular surfaces thereon engageable by camming surfaces on the cone. Drive means are provided between the leaves and the spindle consisting of lugs extending from the leaves which cooperate with slots formed in a flange on the spindle to transmit torque between the leaves and the spindle.

In a modified form of the invention, an additional spring means is provided for loading the spindle in an axial direction to compensate for irregularities in the cores or in the stands on which the core chucks are mounted.

BRIEF DESCRIPTION OF THE DRAWINGS

A further description of the present invention will be made in conjunction with the attached sheet of drawings which illustrate several specific embodiments.

DESCRIPTION OF THE PREFERRED EMBODIMENTS

Figures 1, 2, 3, 4, 5:
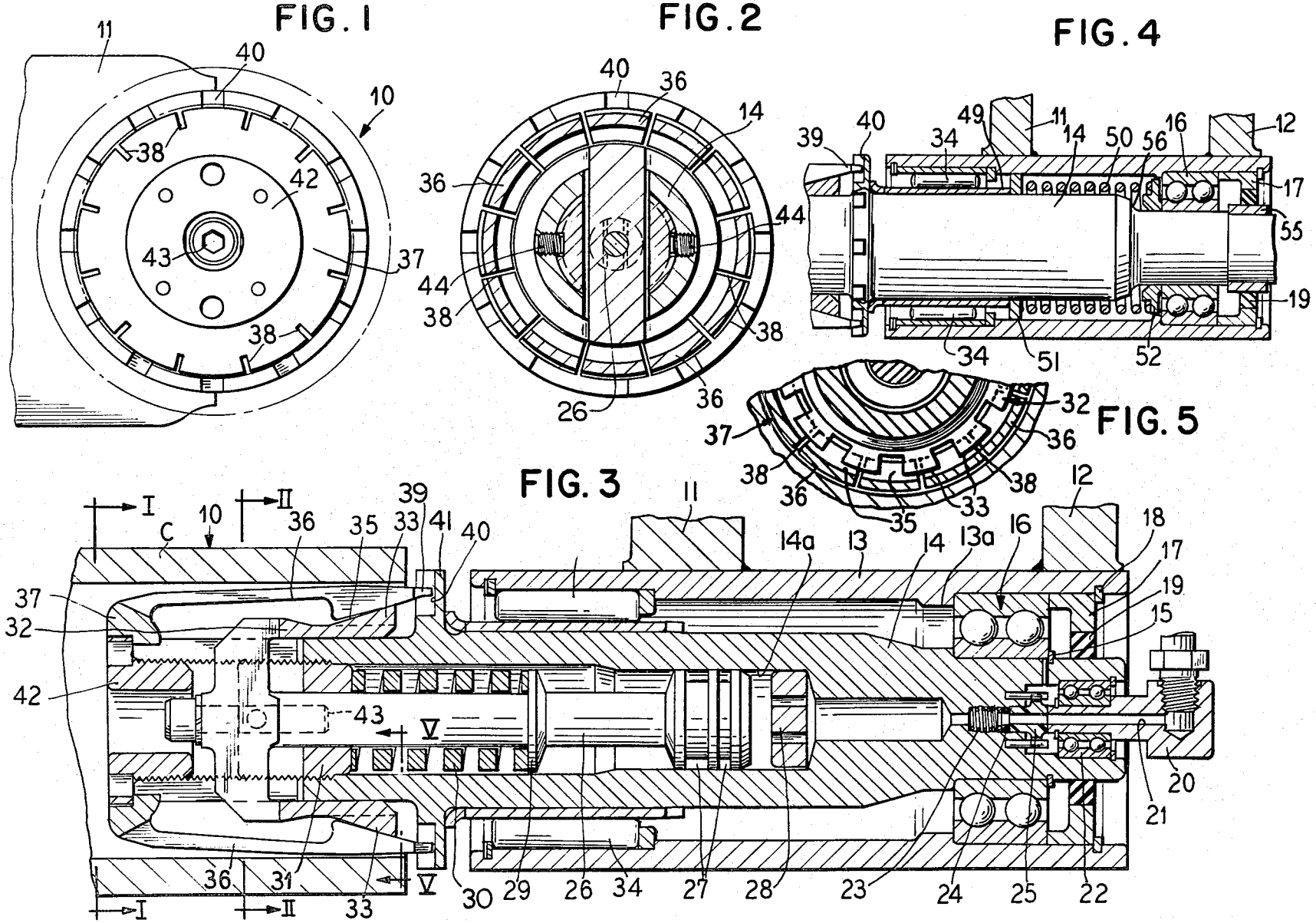
FIG. 1 is an end view of an improved core chuck of the present invention.
FIG. 2 is a cross-sectional view taken substantially along the line II—II of FIG. 3.
FIG. 3 is a cross-sectional view of the improved core chuck of the present invention as it begins to engage the inner diameter of a roll core.
FIG. 4 is a fragmentary cross-sectional view of a modified form of the invention.
FIG. 5 is a fragmentary cross-sectional view taken substantially along the line V—V of FIG. 3.

In FIG. 1, reference numeral 10 indicates generally an improved core chuck of the present invention which is supported from a core chuck stand or the like by means of support arms 11 and 12.

Referring to FIG. 3, a stationary housing 13 is provided and is fixedly secured to the support arms 11 and 12. Rotatably supported coaxially of the housing 13 is a spindle 14. The inner diameter of the housing 13 is provided with a shoulder 13*a*, and a retainer ring 15 is provided near the end of the spindle 14 so as to confine a ball bearing 16 therebetween, the ball bearing 16 functioning as a thrust bearing. An end cover 17 is confined between the bearing 16 and a retaining ring 18 located in a groove of the housing 13. An oil seal ring 19 is confined between the end cover 17 and the end of the spindle 14.

Roller bearings 34 are also provided between the rotatable spindle 14 and the stationary housing 13.

A rotary fitting 20 through which hydraulic fluid can be introduced has an axial bore 21 communicating with the axial bore of the spindle 14. A bearing 22 is positioned at the end of the spindle to accommodate rotary movement between the fitting 20 and the end of the spindle. A spring 23 urges an O-ring 24 and a sealing element 25 against the rotary fitting 20.

Centrally of the spindle 14 there is an enlarged axial bore 14*a*. Mounted for reciprocation within the bore 14*a* is a piston 26 carrying ring seals 27. A piston bumper 28 having passages therethrough for the passage of hydraulic fluid may be included within the axial bore 14*a* to simplify manufacturing procedures, but is not a necessary element of the invention.

Near the center of the piston 26 there is a flange 29 against which a biasing spring 30 acts. The opposite end of the spring 30 is bottomed against a spring plug 31 which is received in threaded engagement within the end of the spindle 14. Set screws 44 are provided to prevent relative movement of spring plug 31 with respect to the spindle 14 as best indicated in FIG. 2. As evident from the drawings, the bias provided by the spring 30 opposes the hydraulic pressure acting on the opposite end of the piston 26 to insure rapid retraction of the core chuck.

The piston 26 acts against a cone 32 which has formed on it a number of camming surfaces 33. The camming surfaces 33 are separated by spaces to provide some inherent flexibility to the surfaces, and enabling radial pressure on the camming surfaces to close the cone into tight-fitting engagement on the spindle 14.

The camming surfaces 33 are arranged to abut and apply pressure to angular faces 35 extending from leaves 36 formed in a cup member 37. The leaves 36 are separated by slots 38 so that each of the twelve leaves illustrated in FIG. 1 is independently deflectable. Each of the leaves 36 is provided with a lug 39 arranged to be received within slots 40 formed in a flange portion 41 forming part of the spindle 14. With this arrangement, the cone 32 can transmit torque from the core C to the spindle 14 if necessary. The flange 41 also transmits thrust from the core C to the thrust bearing 16.

A cap plug 42 holds the expanding cup 37 in place, and serves as a stop for the movement of the cone 32. The cone 32 is made cylindrical and cup shaped, and then its outer end is milled on opposite sides as indicated in FIG. 2 so that it can fit into a large slot milled in the end of the spindle 14. The cone 32 is connected to the piston 26 by means of a headed, threaded pin 43.

The modified form of the invention shown in FIG. 4 is similar in most respects to that shown in FIGS. 1 to 3, inclusive, and the same reference numerals have been used for corresponding parts. In this form of the invention, however, the spindle is spring loaded axially by means of a spring 50 confined between a retaining ring 51 and a retainer 52 which bears against the bearing 16. The retaining ring 51 abuts the inner race 49 which is secured on the spindle 14. A retaining ring 55 is secured on the right end of the spindle 14 by means of a retaining clip, not shown. The spindle 14, therefore, is free to float to the left until retaining ring 55 abuts the inner race of the bearing 16 and is free to move to the right until the inner shoulder 56 of the spindle 14 abuts the retainer 52. This type of configuration is used to compensate for cores having lengths which are beyond normal tolerance limits, and/or the cores which are slightly out of position in their placement on core chuck stands.

In FIG. 3, the piston 26 and the cone 32 are shown at approximately the midposition of their travel when the cone 32 first makes contact with tapered portion 35 of the cup. When fully retracted by the spring 30, the cone is completely free of the cup so that the cup can be easily closed in by a core which is undersized or out-of-round.

It will be understood that the present invention provides a one-piece expanding member which provides its own retaining mechanism and has a multitude of expanding elements.

It should be evident that various modifications can be made to the described embodiments without departing from the scope of the present invention.

I claim as my invention:

1. An expanding core chuck for insertion into a roll core comprising:

a housing, a spindle mounted for rotation within said housing, a cone mounted on said spindle and having angular camming surfaces thereon separated by spaces rendering said camming surfaces inherently flexible, a piston reciprocable axially of said spindle, means for applying hydrostatic pressure to one end of said piston, a cup secured to said spindle, said cup having a plurality of radially independently deflectable leaves in spaced relation therearound separated by first slots, said leaves having angular surfaces thereon engageable by said angular camming surfaces of said cone to close the cone into tight-fitting engagement against said spindle, and drive means cooperating between said leaves and said spindle to transmit torque therebetween.

2. A chuck according to claim 1 which includes:

spring means biasing said piston against the action of said hydrostatic pressure.

3. A chuck according to claim 1 including:

a rotary fitting introducing hydraulic fluid axially of said spindle and against one end of said piston.

4. A chuck according to claim 1 in which:

said cone has a rectangular forward end arranged to be received in a third slot in the end of said spindle.

5. A chuck according to claim 1 in which said cup is of single-piece construction.

6. A chuck according to claim 1 which includes:

a plug received within one end of said spindle and positioned to limit the axial travel of said cone.

7. A chuck according to claim 1 which includes:

thrust bearing means operating between said housing and said spindle.

8. A chuck according to claim 1 which includes:

second spring means loading said spindle in an axial direction.

9. A chuck according to claim 1 in which:

said drive means consist of lugs extending from said leaves, and said spindle having second slots therein for receiving said lugs.

10. A chuck according to claim 9 including:

a flange on said spindle in which said second slots are located.

* * * * *